US009730556B2

(12) United States Patent
Wei

(10) Patent No.: US 9,730,556 B2
(45) Date of Patent: Aug. 15, 2017

(54) TRACK CORNER CONNECTING DEVICE FOR SHOWER DOOR, SHOWER DOOR FRAME AND SHOWER DOOR

(71) Applicant: Ideal Sanitary Ware Co., Ltd., Foshan (CN)

(72) Inventor: Wuxiang Wei, Foshan (CN)

(73) Assignee: Ideal Sanitary Ware Co., Ltd. (CN)

( * ) Notice: Subject to any disclaimer, the term of this patent is extended or adjusted under 35 U.S.C. 154(b) by 0 days.

(21) Appl. No.: 15/100,574

(22) PCT Filed: Jan. 28, 2015

(86) PCT No.: PCT/CN2015/071771

§ 371 (c)(1),
(2) Date: May 31, 2016

(87) PCT Pub. No.: WO2016/119152

PCT Pub. Date: Aug. 4, 2016

(65) Prior Publication Data

US 2016/0353938 A1 Dec. 8, 2016

(51) Int. Cl.

| | |
|---|---|
| ***A47K 3/34*** | (2006.01) |
| ***E06B 3/96*** | (2006.01) |
| ***E06B 3/964*** | (2006.01) |
| ***E06B 3/968*** | (2006.01) |
| ***E05D 15/06*** | (2006.01) |

(52) U.S. Cl.

CPC ..... *A47K 3/34* (2013.01); *E05D 15/0621* (2013.01); *E06B 3/96* (2013.01); *E06B 3/9636* (2013.01); *E06B 3/9641* (2013.01); *E06B 3/9687* (2013.01)

(58) Field of Classification Search

CPC A47K 3/34; E06B 3/96; E06B 3/9636; E06B 3/9641; E06B 3/9687; E05D 15/0621

USPC ..... 4/610

See application file for complete search history.

(56) References Cited

U.S. PATENT DOCUMENTS

2002/0157318 A1* 10/2002 Teubert ..... A47K 3/34 49/360

FOREIGN PATENT DOCUMENTS

| | | | |
|---|---|---|---|
| CN | 103519728 | A | 1/2014 |
| CN | 203476960 | U | 3/2014 |
| CN | 203702788 | U | 7/2014 |
| CN | 204246030 | U | 4/2015 |
| CN | 104704184 | A | 6/2015 |
| CN | 204457318 | U | 7/2015 |

(Continued)

OTHER PUBLICATIONS

International Search Report for Application No. PCT/CN2015/071771 dated Sep. 1, 2015.

*Primary Examiner* — Tuan N Nguyen

(74) *Attorney, Agent, or Firm* — Lerner, David, Littenberg, Krumholz & Mentlik, LLP

(57) ABSTRACT

This invention relates to the field of bathroom devices, and particularly to a track corner connecting device for a shower door used in a shower room, a shower door frame and a shower door. The track corner connecting device for a shower door comprises: an inserting member, a receiving member and a protective cover. The shower door frame comprises a track and aside frame. Two tracks forming an included angle therebetween are connected by the above connecting device. The shower door comprises a shower door frame and a glass plate mounted therein.

20 Claims, 4 Drawing Sheets

(56) References Cited

FOREIGN PATENT DOCUMENTS

| | | | |
|---|---|---|---|
| DE | 2900001 | A1 | 7/1980 |
| JP | 2004225295 | A | 8/2004 |

* cited by examiner

TRACK CORNER CONNECTING DEVICE FOR SHOWER DOOR, SHOWER DOOR FRAME AND SHOWER DOOR

CROSS-REFERENCE TO RELATED APPLICATIONS

The present application is a national phase entry under 35 U.S.C §371 of International Application No. PCT/CN2015/071771 filed Jan. 28, 2015, which is hereby incorporated herein by reference.

TECHNICAL FIELD

This invention relates to the field of bathroom devices, and particularly to a shower door mounted in a shower room, a shower door frame and a track corner connecting device for the shower door.

BACKGROUND TECHNOLOGY

Nowadays, people usually set a shower room in the bathroom during decoration, and the shower room usually employs a shower door having a glass plate. Currently, shower doors are mainly divided into two kinds of structures, namely, a sliding door with a track and a hinge door with a hinge.

A hinge door has a frame made of metal, the frame is provided with glass plates therein, and in general, at least one glass plate is a fixed glass plate fixed in the frame, i.e., the fixed glass plate cannot move relative to the frame. Besides, the frame is further provided therein with at least one flexible glass plate which can rotate around the fixed glass plate, and flexible and fixed glass plates are connected via two or more hinges. The door will be opened or closed just by pushing the flexible glass plate and causing it to rotate around the axis of the hinges.

A sliding door has a frame made of metal, the frame includes one or more tracks provided at an upper end or a lower end of the shower door, and the track is arranged substantially parallel to the floor. Besides, the side frames are provided at both sides of the frame and are arranged to be perpendicular to the track, and the side frames are fixedly connected to the track. The frame is provided therein with at least two glass plates which can be flexible glass plates sliding back and forth in the track, and can also have at least one fixed glass plate that cannot slide relative to the track. If a fixed glass plate is set, then the shower door will include at least one flexible glass plate that can slide back and forth in the track.

It is possible for both a shower door having a hinge door structure and a shower door having a sliding door structure to be a shower door with a bending structure. As show in FIG. 1, such a shower door includes a plurality of tracks, wherein the upper track includes two tracks 10 and 11 forming an included angle therebetween and the lower track includes two tracks 12 and 13 forming an included angle therebetween. The shower door is provided with side frames 14 and 15 extending in a perpendicular direction at both sides of the shower door adjacent to the walls, a glass plate 16 is mounted in the tracks 10 and 12 and the side frame 14, and a glass plate 17 is mounted in the tracks 11 and 13 and the side frame 15. A connecting device 18 is provided at a corner between the tracks 10 and 11, and a connecting device 19 is also provided at a corner between the tracks 12 and 13.

Since the included angle between the tracks 10 and 11 may be an angle such as 90° or 135°, the current connecting devices 18 and 19 are designed into required angles according to the included angles between the tracks, and are provided with screw holes thereon. When mounting the shower door, the tracks and the connecting devices are connected using screws, but such a method is time-and-labor-consuming for installation staff.

Other available connecting devices are designed to have a plurality of components, wherein one component is connected with a track while another component with another track, then a third component is used to connect the above two components, thereby achieving connection between the two tracks. Although such a method spares screws in field installation, the connecting device has a large number of components, and some connecting devices even needs to be assembled in advance; therefore, mounting the shower door will take a long time, and the cost for producing and mounting the shower door will increase.

Technical Problems

To solve the above problems, the main objective of this invention is to provide a track corner connecting device for a shower door with a small number of parts and convenient assembly.

Another objective of this invention is to provide a shower door frame, requiring no installation tool and no screws when installing a track with a corner.

A further objective of this invention is to provide a shower door with short installation time and low manufacturing cost.

Technical Solutions

To realize the main objective of this invention, this invention provides a track corner connecting device for a shower door, the track corner connecting device comprising: an inserting member, a receiving member and a protective cover, the inserting member fixedly connected to a first track of a shower door, the receiving member fixedly connected to a second track of the shower door, wherein: the inserting member comprises an insert provided with a first open pin hole; the receiving member comprises a receiver provided with a second open pin hole, wherein after the insert is inserted into the receiver, the first and second open pin holes are coaxial; and the protective cover is provided with a pin configured to be inserted into the first and second open pin holes.

According to a preferred solution, the receiver comprises a top wall and a bottom wall opposite the top wall, the second open pin hole is provided below the top wall, and the bottom wall is provided with a pin hole coaxially arranged with the second open pin hole.

According to a further solution, after the insert is inserted into the receiver, the first open pin hole is positioned between the second open pin hole and the pin hole.

According to a further solution, at least one first position-limiting projection is provided on a surface of the insert adjoining the first track, and at least one second position-limiting projection is provided on a surface of the receiving member adjoining the second track.

According to a further solution, the pin is fixed on a top wall of the protective cover and extends downwards therefrom, the protective cover comprises an interior decorative sheet and an external decorative sheet, and the pin is connected to the interior decorative sheet and/or the external decorative sheet via a connecting rib.

According to a further solution, the inserting member is provided with a first body positioned at a side of the insert and adjoining the first track, the receiving member is provided with a second body positioned at a side of the receiver and adjoining the second track; and the protective cover is provided with a first opening to which the first body is mounted and a second opening to which the second body is mounted.

According to a further solution, the first and second openings are respectively located on two adjacent surfaces of the protective cover and between the interior and external decorative sheets.

According to a further solution, a lower end of the protective cover is provided with an exit-preventing member buckled on a lower end surface of the receiving member To realize another objective of this invention, this invention provides a shower door frame, comprising: a track extending horizontally and an side frame arranged perpendicularly to the track, the track comprising a first track and a second track forming an included angle therebetween, the first and second tracks being connected via a connecting device, wherein: the connecting device comprises an inserting member, a receiving member and a protective cover, the inserting member fixedly connected to a first track of a shower door, the receiving member fixedly connected to a second track of the shower door; the inserting member comprises an insert provided with a first open pin hole; the receiving member comprises a receiver provided with a second open pin hole, wherein after the insert is inserted into the receiver, the first and second open pin holes are coaxial; and the protective cover is provided with a pin configured to be inserted into the first and second open pin holes.

To realize another objective of this invention, this invention provides a shower door, comprising: a track extending horizontally and a side frame arranged perpendicularly to the track, the side frame being mounted with a glass plate therein, the track comprising a first track and a second track forming an included angle therebetween, the first and second tracks being connected via a connecting device, wherein: the connecting device comprises an inserting member, a receiving member and a protective cover, the inserting member fixedly connected to a first track of the shower door, the receiving member fixedly connected to a second track of the shower door; the inserting member comprises an insert provided with a first open pin hole; the receiving member comprises a receiver provided with a second open pin hole, wherein after the insert is inserted into the receiver, the first and second open pin holes are coaxial; and the protective cover is provided with a pin configured to be inserted into the first and second open pin holes.

Advantageous Effects

The connecting device used in the shower door provided in this invention has an inserting member, a receiving member and a protective cover, wherein the inserting member can be inserted into the receiving member, a pin of the protective cover can be inserted into a first open pin hole of the inserting member and a second open pin hole of the receiving member thereby fixing the inserting member and the receiving member. The inserting member is fixedly connected with the first track, and the receiving member is connected with the second track, such that connection between the first track and the second track of the shower door can be realized simply; in addition, no screw or tool will be required for the installation between the two tracks, the installation of the shower door frame consumes less time, and the assembling operation is simple, so that costs for production and installation of a shower door can be reduced.

Besides, since the track corner connecting device of the track only includes one inserting member, one receiving member and one protective cover, it requires fewer components, and thus can further reduce the production cost of the shower door.

In addition, by limiting the positions of a first body of the inserting member and of a second body of the receiving member by the first and the second openings of the protective cover, the positional relationship among the inserting member, the receiving member and the protective cover is determined, and fixation between the inserting member and the receiving member is realized, preventing the inserting member and the receiving member from rotating around the pin.

Moreover, a lower end of the protective cover is provided with an exit-preventing member that can effectively fix the protective cover outside the receiving member thereby preventing the protective cover from falling from the receiving member.

This invention will be further explained in combination with the figures and the embodiments.

EMBODIMENTS

The shower door of this invention is mounted in a shower room, is in a bent shape and has a shower door frame and a glass plate mounted in the shower door frame. The shower door frame includes a track extending in a horizontal direction and side frames perpendicular to the track. The track includes an upper track mounted at an upper side of the glass plate and a lower track mounted at a lower side of the glass plate, wherein the upper track includes a first track and a second track forming an included angle therebetween, the included angle between the first track and the second track is 90° or 135°, and the first and second tracks are connected via a connecting device. The lower track also includes a first track and a second track forming an included angle therebetween, the included angle between the first track and the second track is 90° or 135°, and the first and second tracks are also connected via a connecting device. This invention mainly improves the connecting device that connects the first track with the second track, and the structure of the connecting device will be described in detail in the followings.

Figure 1:
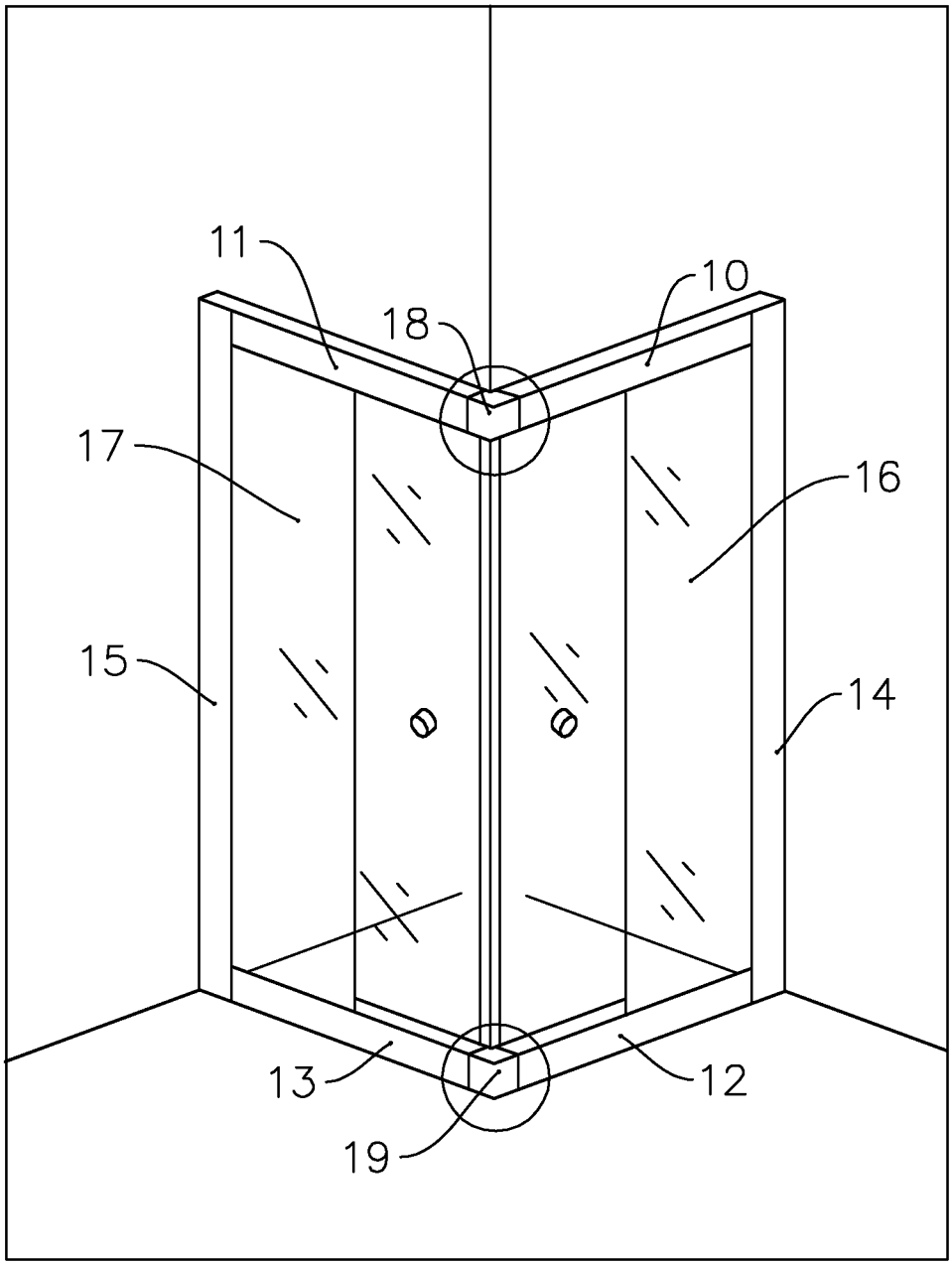
FIG. 1 is a structural view of a shower door mounted in the shower room according to the prior art.
Figure 2:
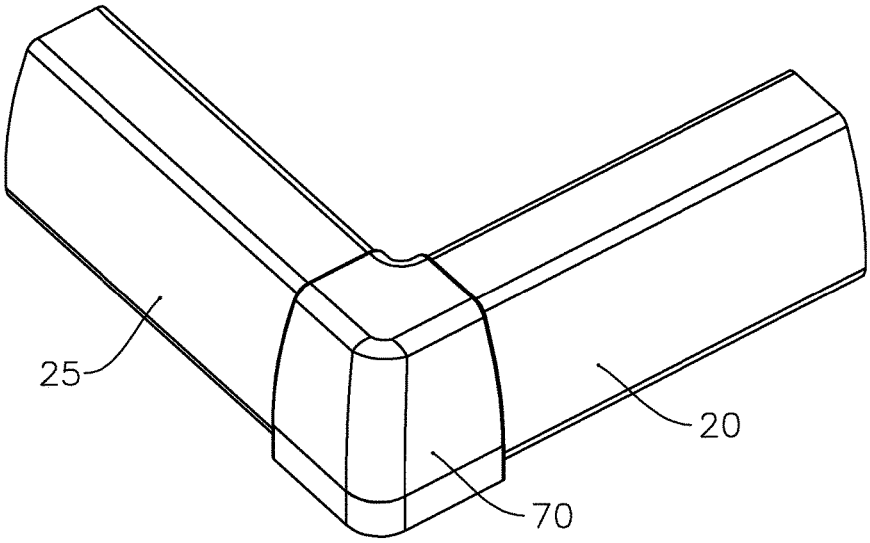
FIG. 2 is a structural view of an embodiment of the track corner connecting device of the shower door and the track according to the invention.

With reference to FIG. 2, the connecting device in this embodiment is used to connect the first track 20 with the second track 25, and an included angle of 90° is formed between the first track 20 and the second track 25.

Figure 3:
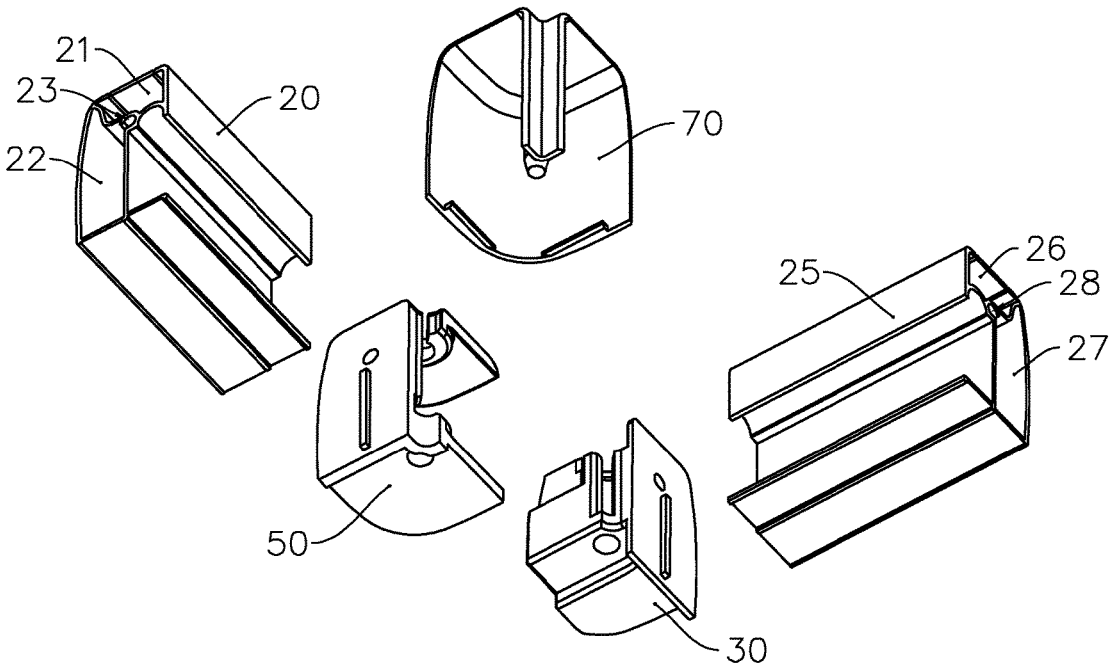
FIG. 3 is a structural exploded view of an embodiment of the track corner connecting device of the shower door and the track according to the invention.

With reference to FIG. 3, the connecting device includes an inserting member 30, a receiving member 50, and a protective cover 70 that wraps the inserting member 30 and the receiving member 50. The first track 20 is a strip-shaped profiles having sealed chambers 21 and 22, a screw hole 23 is provided between the sealed chambers 21 and 22, and a screw can be threaded into the screw hole 23. Similarly, the second track 25 is also a strip-shaped profiles provided in its longitudinal direction with sealed chambers 26 and 27 which extend along the longitudinal direction thereof, and a screw hole 28 is provided between the sealed chambers 26 and 27.

Figure 4:
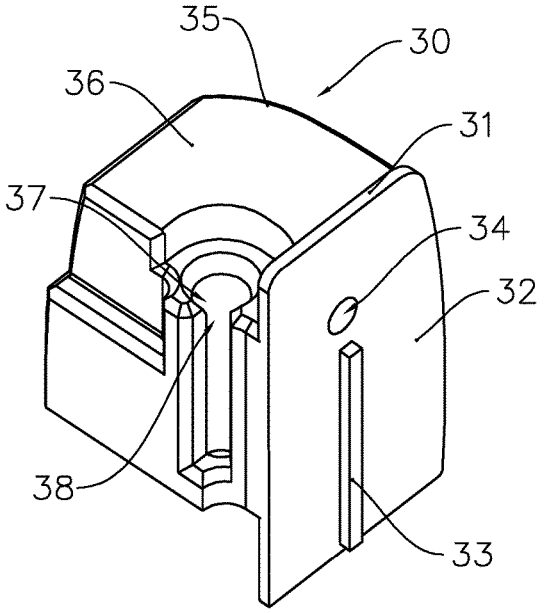
FIG. 4 is a structural view of the inserting member of an embodiment of the track corner connecting device of the shower door according to the invention from a first view point.
Figure 5:
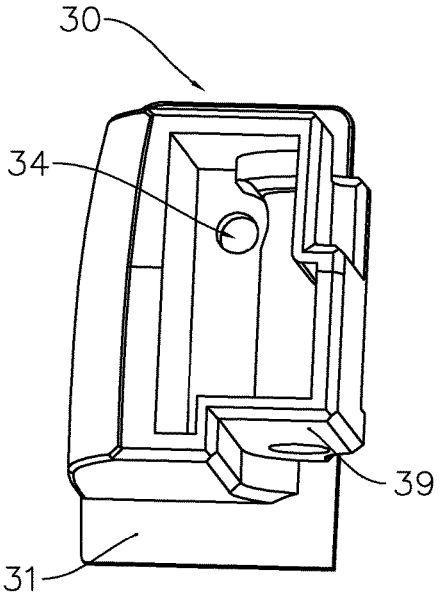
FIG. 5 is a structural view of the inserting member of an embodiment of the track corner connecting device of the shower door according to the invention from a second view point.

With reference to FIG. 4 and FIG. 5, the inserting member 30 has a sheet-shaped first body 31 which is provided with a position-limiting projection 33 on a surface 31 adjacent to the first track 20, and the position-limiting projection 33 can be inserted into the sealed chamber 21 or 22 of the first track 20 thereby limiting movement of the inserting member 30 relative to the first track 20, i.e., avoiding rotation of the inserting member 30. The first body 31 is also provided with a through hole 34 through the surfaces of both sides of the first body 31, the screw can pass through the through hole 34 and be threaded into the screw hole 23 of the first track 20, and thereby the inserting member 30 is fixed at an end of the first track 20. Of course, the inserting member 30 can also be fixed at an end of the first track 20 via a rivet or by means of welding.

The first body 31 is provide with an insert 35 in a direction opposite to the first track 20, and the insert 35 is formed by extending outwards from the surface of the first body 31 and is substantially columnar. The insert 35 has a top wall 36 and a bottom wall 39 provided opposite to the top wall, an open pin hole 37 is provided between the top wall 36 and the bottom wall 39, an opening 38 is provided at a side of the open pin hole 37, and the opening 38 extends along an axis of the open pin hole 37. Besides, the open pin hole 37 extends from the top wall 36 to the bottom wall 39, and the axis of the open pin hole 37 is perpendicular to the top wall 36 and the bottom wall 39.

Figure 6:
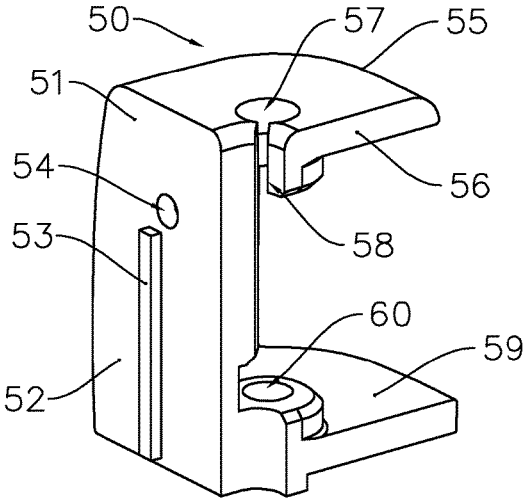
FIG. 6 is a structural view of the receiving member of an embodiment of the track corner connecting device of the shower door according to the invention from a first view point.
Figure 7:
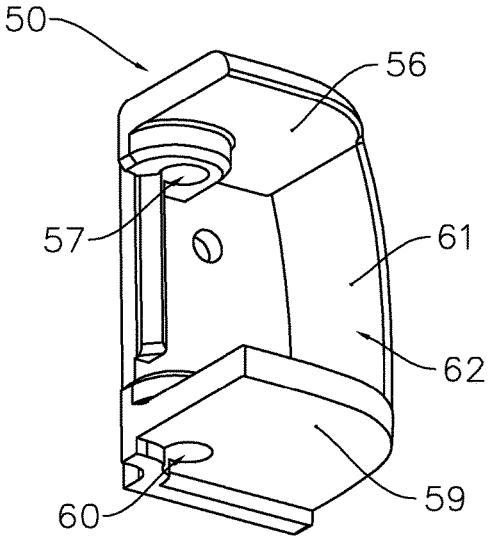
FIG. 7 is a structural view of the receiving member of an embodiment of the track corner connecting device of the shower door according to the invention from a second view point.

With reference to FIG. 6 and FIG. 7, the receiving member 50 has a sheet-shaped second body 51, the second body 51 is provided with a strip-shaped position-limiting projection 53 on a surface 52 of the second body 51 adjacent to the second track 25, and the position-limiting projection 53 can be inserted into the sealed chamber 53 or 54 of the second track 25 thereby limiting movement of the receiving member 50 relative to the second track 25, i.e., avoiding rotation of the receiving member 50 relative to the second track 25. The second body 51 is also provided with a through hole 54 through the surfaces of two sides of the second body 51, a screw can pass through the through hole 54 and be threaded into the screw hole 28 of the second track 25, and thereby the receiving member 54 is fixed at an end of the second track 25. Of course, in practical application, the receiving member 50 can also be fixed at an end of the second track 25 via a rivet or by means of welding.

The receiving member 50 is also provided with a receiver 55, the receiver 55 extends outwards from a side of the second body 51 is opposite the surface 51, and is provided with a top wall 56 and a bottom wall 59 opposite to the top wall 56, and the top wall 56 and the bottom wall 59 are connected via a side wall 61. The top wall 56, the bottom wall 59, the side wall 61 and the second body 51 encompass a receiving chamber 62 having an opening, and the insert 35 can be inserted into the receiving chamber 62.

The receiver 55 is provided with an open pin hole 57, a side of the open pin hole 57 is provided with an opening 58, and an axis of the open pin hole 57 is perpendicular to the top wall 56 and the bottom wall 59, and the opening 58 extends along a direction of the axis of the open pin hole 57. It can be seen from FIG. 6 that the open pin hole 57 does not extend through from the top wall 56 to the bottom wall 59; therefore, there is a gap between the open pin hole 57 and the bottom wall 59, so as to facilitate insertion of the inserting member 30 between the top wall 56 and the bottom wall 59.

The bottom wall 59 is provided with a pin hole 60 which is located right underneath the open pin hole 57, and the pin hole 60 is arranged to be coaxial with the open pin hole 57.

Figure 8:
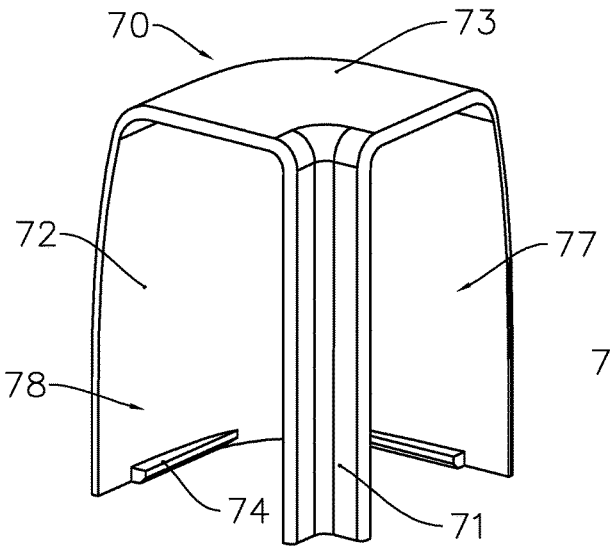
FIG. 8 is a structural view of the protective cover of an embodiment of the track corner connecting device of the shower door according to the invention from a first view point.
Figure 9:
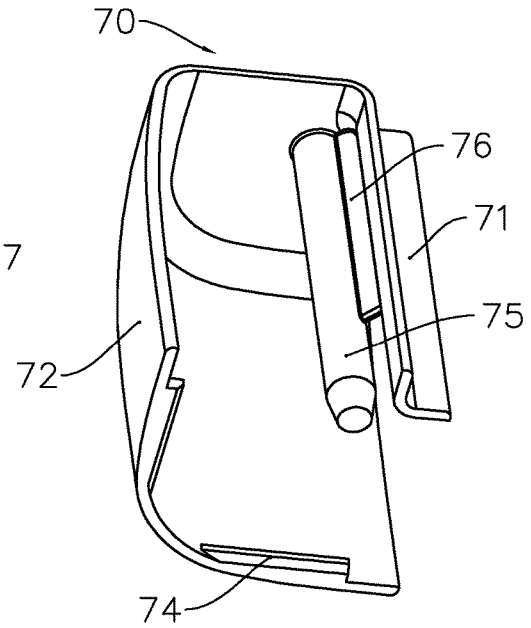
FIG. 9 is a structural view of the protective cover of an embodiment of the track corner connecting device of the shower door according to the invention from a second view point.

With reference to FIG. 8 and FIG. 9, the protective cover 70 has an interior decorative sheet 71 and an external decorative sheet 72 located outside the interior decorative sheet 71, the interior decorative sheet 71 and the external decorative sheet 72 are connected via a top wall 73, and an area of the interior decorative sheet 71 is smaller than an area of the external decorative sheet 72. The interior decorative sheet 71 is provided with a pin 75 at a side adjacent to the external decorative sheet 72, and the pin 75 extends in a direction perpendicular to the top wall 73 from a lower surface of the top wall 73. In order to prevent the pin 75 from being damaged, a connecting rib 76 is connected between the pin 75 and the interior decorative sheet 71. Of course, the pin 75 can also be provided at a side adjacent to the external decorative sheet 72 with the connecting rib connected between the external decorative sheet 72 and the pin 75.

A lower end of the protective cover 70 is provided with two exit-preventing members 74 respectively provided at a lower end of the external decorative sheet 72, and the two exit-preventing members 74 are respectively buckled on a lower end surface of the receiving member 50 so as to prevent the protective cover 70 from falling from the receiving member 50.

Figure 10:
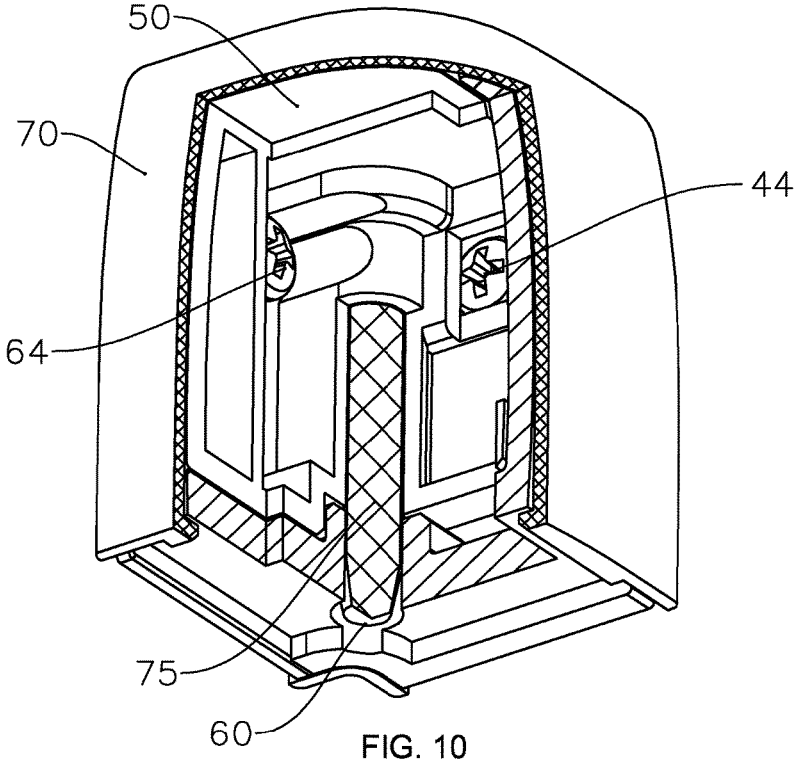
FIG. 10 is a revolved sectional view of an embodiment of the track corner connecting device of the shower door according to the invention.

When assembling the frame of the shower door, the inserting member 30 is fixed to an end of the first track 20, and the receiving member 50 is fixed to an end of the second track 25, as shown in FIG. 10, by using a screw 44 that passes through the through hole 34 of the inserting member 30 and is threaded into the screw hole 23, the first body 31 adjoins the first track 20, and by using a screw 64 that passes through the through hole 54 of the receiving member 50 and is threaded into the screw hole 28, the second body 51 adjoins the second track 25.

Then, the inserting member 30 is inserted into a receiving chamber 62 of the receiving member 50, and the axis of the open pin hole 37 of the inserting member 30 is aligned with the axis of the open pin hole 57 of the receiving member 50, such that the axes of the open pin holes 37 and 57 and the pin hole 60 are in one straight line. At this time, the open pin hole 37 is located between the open pin hole 57 and the pin hole 60.

At last, the protective cover 70 is buckled outside the receiving member 50; in other words, the pin 75 is inserted into the open pin holes 37 and 57. The protective cover 70 is inserted into the receiving member 50 and the inserting member 30 from the top down. Along with the inserting of the pin 75, the lower end of the pin 75 will be inserted into the pin hole 60 thereby realizing fixation of the inserting member 30 and the receiving member 50.

In order to avoid relative movement between the inserting member 30 and the receiving member 50, the connecting rib 76 is inserted into the opening 38 of the open pin hole 37 and the opening 58 of the open pin hole 57 thereby avoiding rotation of the inserting member 30 and the receiving member 50. Besides, as shown in FIG. 8, the protective cover 70 is provided with two openings 77 and 78 which are respectively located on two adjacent side walls of the protective cover 70. When the protective cover 70 is mounted outside the receiving member 50, the first body 31 of the inserting member 30 and the second body 51 of the receiving member 50 are respectively mounted on the two openings 77 and 78, and, through cooperation of the first body 31, the second body 51 and the two openings 77 and 78, rotation of the protective cover 70 relative to the inserting member 30 and the receiving member 50 is limited, and whereby the inserting member 30 and the receiving member 50 are fixed in the protective cover 70.

In addition, when the protective cover 70 is mounted to the receiving member 50, the exit-preventing member 74 is buckled on the lower end surface of the receiving member 50 thereby fixing the protective cover 70 to the receiving member 50, so as to prevent the protective cover 70 from falling from the receiving member 50.

The shower door track corner connecting device of this invention achieves fixed connection of the first track 20 and the second track 25 through cooperation of the inserting member 30, the receiving member 50 and the protective cover 70, and can prevent the first track 20 and the second track 25 from rotating with respect to each other. It can be seen from the above assembling process that the assembly of the shower door is so simple that it can be mounted without any tools, and the connecting device has fewer components, which can reduce the production and installation costs of the shower door.

INDUSTRIAL APPLICABILITY

The shower door provided in this invention is mounted in a bathroom as a significant constituent of the shower room. The shower room can be an integrated shower room with a chassis, and can also be such a shower room that is provided by the encircling of shower door and the walls, in which the shower door is mounted between two adjacent walls that form an included angle. The shower door in this invention can be a shower door that includes only an upper track, and can also be a shower door that has both an upper track and a lower track, and the tracks of the shower door are connected via the above-mentioned connecting device.

The shower door is suitable for field installation in a bathroom of a customer. By applying the product of this invention, the assembling operation of the shower door is simple, and there is no need to use screws to fix and connect the two tracks that form an included angle; thus, assembling of the shower door consumes less time, thereby achieving fast and easy installation of the shower door and reducing the costs for producing and assembling the same.

The invention claimed is:

1. A track corner connecting device for a shower door, comprising:

an inserting member, a receiving member and a protective cover, the inserting member fixedly connected to a first track of the shower door, the receiving member fixedly connected to a second track of the shower door, wherein:

the inserting member comprises an insert provided with a first open pin hole;

the receiving member comprises a receiver provided with a second open pin hole, wherein after the insert is inserted into the receiver, the first and second open pin holes are coaxial; and the protective cover is provided with a pin configured to be inserted into the first and second open pin holes.

2. The track corner connecting device for a shower door according to claim 1, wherein the receiver comprises a top wall and a bottom wall opposite the top wall, the second open pin hole is provided below the top wall, and the bottom wall is provided with a pin hole coaxially arranged with the second open pin hole.

3. The track corner connecting device for a shower door according to claim 2, wherein after the insert is inserted into the receiver, the first open pin hole is positioned between the second open pin hole and the pin hole.

4. The track corner connecting device for a shower door according to claim 1, wherein: the inserting member is provided with a first body positioned at a side of the insert and adjoining the first track, the receiving member is provided with a second body positioned at a side of the receiver and adjoining the second track; and the protective cover is provided with a first opening to which the first body is mounted and a second opening to which the second body is mounted.

5. The track corner connecting device for a shower door according to claim 1, wherein at least one first position-limiting projection is provided on a surface of the inserting member adjoining the first track.

6. The track corner connecting device for a shower door according to claim 1, wherein at least one second position-limiting projection is provided on a surface of the receiving member adjoining the second track.

7. The track corner connecting device for a shower door according to claim 4, wherein: the pin is fixed on a top wall of the protective cover and extends downwards therefrom.

8. The track corner connecting device for a shower door according to claim 7, wherein: the protective cover comprises an interior decorative sheet and an external decorative sheet, and the pin is connected to the interior decorative sheet and/or the external decorative sheet via a connecting rib.

9. The track corner connecting device for a shower door according to claim 8, wherein: the first and second openings are respectively located on two adjacent surfaces of the protective cover, and between the interior decorative sheet and the external decorative sheet.

10. The track corner connecting device for a shower door according to claim 1, wherein a lower end of the protective cover is provided with an exit-preventing member buckled on a lower end surface of the receiving member.

11. A shower door frame, comprising:

a track extending horizontally and a side frame arranged perpendicularly to the track, the track comprising a first track and a second track forming an included angle therebetween, the first and second tracks being connected via a connecting device, wherein:

the connecting device comprises an inserting member, a receiving member and a protective cover, the inserting member fixedly connected to a first track of a shower door, the receiving member fixedly connected to a second track of the shower door;

the inserting member comprises an insert provided with a first open pin hole;

the receiving member comprises a receiver provided with a second open pin hole, wherein after the insert is inserted into the receiver, the first and second open pin holes are coaxial; and the protective cover is provided with a pin configured to be inserted into the first and second open pin holes.

12. The shower door frame according to claim 11, wherein the receiver comprises a top wall and a bottom wall opposite the top wall, the second open pin hole is provided below the top wall, and the bottom wall is provided with a pin hole coaxially arranged with the second open pin hole.

13. The shower door frame according to claim 12, wherein after the insert is inserted into the receiver, the first open pin hole is positioned between the second open pin hole and the pin hole.

14. The shower door frame according to claim 11, wherein the inserting member is provided with a first body positioned at a side of the insert and adjoining the first track, the receiving member is provided with a second body positioned at a side of the receiver and adjoining the second track; and the protective cover is provided with a first opening to which the first body is mounted and a second opening to which the second body is mounted.

15. The shower door frame according to claim 11, wherein the pin is fixed on a top wall of the protective cover and extends downwards therefrom.

16. The shower door frame according to claim 14, wherein the protective cover comprises an interior decorative sheet and an external decorative sheet, and the pin is connected to the interior decorative sheet and/or the external decorative sheet via a connecting rib.

17. The shower door frame according to claim 16, wherein the first and second openings are respectively located on two adjacent surfaces of the protective cover, and between the interior and external decorative sheets.

18. The shower door frame according to claim 11, wherein a lower end of the protective cover is provided with an exit-preventing member buckled on a lower end surface of the receiving member.

19. A shower door, comprising:

a track extending horizontally and a side frame arranged perpendicularly to the track, the side frame being mounted with a glass plate therein, the track comprising a first track and a second track forming an included angle therebetween, the first and second tracks being connected via a connecting device, wherein:

the connecting device comprises an inserting member, a receiving member and a protective cover, the inserting member fixedly connected to a first track of the shower door, the receiving member fixedly connected to a second track of the shower door;

the inserting member comprises an insert provided with a first open pin hole;

the receiving member comprises a receiver provided with a second open pin hole, wherein after the insert is inserted into the receiver, the first and second open pin holes are coaxial; and the protective cover is provided with a pin configured to be inserted into the first and second open pin holes.

20. The shower door according to claim 19, wherein the receiver comprises a top wall and a bottom wall opposite the top wall, the second open pin hole is provided below the top wall, and the bottom wall is provided with a pin hole coaxially arranged with the second open pin hole.

* * * * *